United States Patent [19]

Grunder

[11] Patent Number: 4,966,354

[45] Date of Patent: Oct. 30, 1990

[54] METHOD OF AND MACHINE FOR GATHERING PAPER SHEETS AND THE LIKE

[75] Inventor: Roland Grunder, Vordemwald, Switzerland

[73] Assignee: Grapha-Holding AG, Hergiswil, Switzerland

[21] Appl. No.: 356,584

[22] Filed: May 22, 1989

Related U.S. Application Data

[63] Continuation of Ser. No. 134,000, Dec. 17, 1987, abandoned.

[30] Foreign Application Priority Data

Dec. 18, 1986 [CH] Switzerland ..... 5049/86-3

[51] Int. Cl.[5] ..... B65H 43/02

[52] U.S. Cl. ..... 270/56; 270/54; 270/58; 271/263

[58] Field of Search ..... 270/54–59; 271/262, 263

[56] References Cited

U.S. PATENT DOCUMENTS

| | | | |
|---|---|---|---|
| 3,519,264 | 7/1970 | Beacham et al. | 270/54 |
| 3,561,752 | 2/1971 | McCain | 270/54 |
| 4,170,346 | 10/1979 | Murray et al. | 270/54 |
| 4,471,954 | 9/1984 | Bourg | 271/263 |

FOREIGN PATENT DOCUMENTS

| | | | |
|---|---|---|---|
| 3424655 | 2/1986 | Fed. Rep. of Germany | 271/262 |

*Primary Examiner*—Edward J. Look
*Assistant Examiner*—Therese M. Newholm
*Attorney, Agent, or Firm*—Peter K. Kontler

[57] ABSTRACT

The thickness of successive sheets which are delivered by the feeders of a gathering machine to a collating conveyor are monitored and a computer which is associated with each feeder calculates the extent of deviation of the monitored thickness from an acceptable value. Signals which are generated by the computers in the event of excessive deviation are used to arrest the motor of the gathering machine and/or to expel the respective groups of sheets from the collating conveyor. Each computer is caused to calculate a reference value on the basis of monitored thicknesses of n successively delivered sheets whose thicknesses are within the acceptable range.

20 Claims, 2 Drawing Sheets

METHOD OF AND MACHINE FOR GATHERING PAPER SHEETS AND THE LIKE this application is a continuation of application Ser. No. 134,000, filed Dec. 17, 1987 now abandoned.

BACKGROUND OF THE INVENTION

The invention relates to a method of manipulating sheets in a gathering machine and to a machine which can be used for the practice of the method. More particularly, the invention relates to improvements in a method of manipulating sheets in a gathering machine of the type wherein one or more sheet feeding units or feeders serve to supply successions of sheets into a predetermined path which is defined by a collating conveyor whereon the sheets are accumulated into stacks of overlapping sheets or into similar formations. A gathering machine of the class to which the present invention pertains is disclosed, for example, in commonly owned U.S. Pat. No. 3,414,257 granted Dec. 3, 1968 to Hans Muller.

German Offenlegungsschrift No. 34 24 665 discloses a method according to which sheets are collated to form a series of groups of n sheets each. When the gathering machine which is used for the practice of the method is set up for the gathering of a different series of groups of sheets, the foremost sheets which issue from the feeders are monitored to ascertain their thickness and the monitored thickness is used as a reference value for comparison with monitored thicknesses of the next-following sheets which are being supplied by the respective feeders. The average thickness of the first n sheets which are supplied by each of the feeders is ascertained by an evaluating unit and the thus obtained average thickness is used as a reference value for comparison with monitored thicknesses of the next-following n sheets. In calculating the average thickness, the evaluating unit disregards the missing sheets, if any. If the foremost sheet of the first series of sheets which are being supplied by a particular feeder is missing, all next-following sheets of the same groups are designated as defective (their thickness deviates from the (zero) thickness of the non-existing or missing foremost sheet of the respective group) so that all next-following sheets of the same group are discarded. Alternatively, if the foremost sheet of the first series or group is defective (i.e., its thickness is excessive or unsatisfactory), all sheets of the first series or group which exhibit the same defect are retained in the machine and are processed as satisfactory sheets.

Gathering machines of the type suitable for practice of the method which is disclosed in the aforementioned Offenlegungsschrift are often called upon to gather groups of twenty or more sheets into books, brochures or pamphlets. The likelihood that the machine would turn out unsatisfactory accumulations of twenty or more sheets each is most pronounced after a change of setup, i.e., when the machine is restarted to proceed with the gathering of different sheets or different numbers of sheets in order to form a series of stacks or similar accumulations. At such time, the individual feeders (such feeders normally comprise suction cups or like devices serving to withdraw successive sheets from a magazine and to deliver the withdrawn sheets to an opening device which drops them onto a collating conveyor) are most likely to deliver unsatisfactory sheets, not to deliver any sheets or to simultaneously deliver two or more sheets. The method which can be practiced in accordance with the teaching of the aforementioned Offenlegungsschrift does not take into consideration the fact that the feeders are more likely to operate unsatisfactorily immediately after a change of setup. Therefore, the machine which is operated in accordance with such method is likely to turn out large numbers of unsatisfactory accumulations of sheets or to discard large numbers of satisfactory sheets. The reason is that the method merely provides for detection of the absence of sheets at the start of a gathering operation but it does not take into consideration the possibility that the foremost item which is supplied by a feeder consists of two or more coherent sheets. The delivery of several superimposed sheets in lieu of discrete sheets can be detected only visually, namely by arresting the machine upon completed withdrawal of the foremost sheets from all of the feeders. If the visual detection is dispensed with and a feeder happens to supply two or more coherent sheets as the first item of a series of n successive items, all satisfactory sheets which follow the foremost item (two or more coherent sheets) are automatically ejected as unsatisfactory since their thicknesses deviate from the thickness of the foremost item. In other words, the evaluating means which is associated with a feeder that has delivered an unsatisfactory item (e.g., two coherent sheets) as the foremost item of a series of n items does not receive and store an acceptable reference signal and the starting routine must be repeated until all of the feeders deliver satisfactory foremost items (i.e., discrete sheets of predetermined thickness). A drawback of such method is that the starting routine must be repeated a number of times, especially if the machine operates with a large number of feeders, which entails huge losses in output and the ejection of large quantities of valuable sheet material.

A frequent cause of unsatisfactory feeding of sheets immediately after the gathering machine is started following a change of setup is improper adjustment of sheet withdrawing and/or separating (singularizing) devices (e.g., needles, nozzles which discharge compressed air, suction cups and the like). If at least one of these devices is improperly adjusted, the machine cannot be started at all because the evaluating unit for the corresponding feeder cannot receive and store an acceptable reference signal.

OBJECTS AND SUMMARY OF THE INVENTION

An object of the invention is to provide a novel and improved method of manipulating sheets in a gathering machine so that the number of rejects is reduced to a minimum and that the machine can be successfully started with a minimum of delay following a change of setup.

Another object of the invention is to provide a method which renders it possible to proceed with orderly operation immediately or shortly after completion of a change of setup.

A further object of the invention is to provide a method which renders it possible to reduce the number of stoppages of the gathering machine after a change of setup.

An additional object of the invention is to provide a method which renders it possible to automatically ascertain the reference value for comparison with monitored characteristics of successive sheets, even if the mechanisms at a particular feeding station are not adjusted with a maximum degree of accuracy.

Still another object of the invention is to provide a novel and improved gathering machine which can be utilized for the practice of the above outlined method.

A further object of the invention is to provide the machine with novel and improved means for processing signals denoting the characteristics (particularly the density) of successive sheets which are supplied by one or more feeders to a collating conveyor whereon the sheets are gathered to form stacks or analogous formations.

An additional object of the invention is to provide novel and improved means for initiating and timing the segregation of unsatisfactory sheets and/or unsatisfactory groups of sheets ahead of the foremost processing station for such formations.

Another object of the invention is to provide the machine with novel and improved means for automatically altering the reference signals for characteristics of sheets which are supplied by various feeders when the characteristics of sheets change but to an extent less than that which would warrant segregation of the corresponding sheets or groups of sheets.

One feature of the present invention resides in the provision of a method of manipulating printed or other sheets in a gathering machine wherein at least one feeder supplies a succession of sheets at predetermined intervals into a predetermined path (e.g., onto a collating conveyor) along which the sheets are transported and wherein the sheets are accumulated into stacks or analogous formations. The method comprises the steps of monitoring the thickness of successive sheets on their way from the at least one feeder into the predetermined path, counting the number of successive monitoring steps, utilizing the last one of a preselected number of successive at least substantially identical monitored thicknesses to select a range of acceptable thicknesses, comparing the monitored thicknesses of successive sheets with a reference value and generating signals which denote the extent of deviation or departure of monitored thickness from the reference value, and expelling the sheets from the predetermined path in response to such signals when the deviation or departure of monitored thickness from the reference value is outside of the aforementioned range.

The method preferably further comprises the steps of counting the number of successive monitoring steps following the utilizing step and employing the last one of a predetermined number of successive at least substantially identical monitored thicknesses following the utilizing step to alter the range when the last monitored thickness of the predetermined number deviates or departs from the last monitored thickness of the preselected number.

The monitoring step can be carried out by scanning at the aforementioned intervals a second path wherein the sheets are advanced from the at least one feeder into the predetermined path, and the method can further comprise the steps of monitoring the second path in the absence of a sheet therein (i.e., ascertaining the thickness of a non-existent or absent sheet) to thus establish a so-called calibrating thickness, monitoring the thickness of the foremost sheet of the succession of sheets advancing along the second path, comparing the monitored thickness of such foremost sheet with the calibrating thickness, and selecting the initial range as a function of the difference between the monitored thickness of the foremost sheet and the calibrating thickness.

As a rule, the gathering machine which is used for the practice of the improved method will employ at least two but normally a much larger number of feeders with a corresponding number of second paths. The method which is practiced with such machine can further comprise the step of expelling from the predetermined path all sheets which are supplied by the feeders until after completion of selection of the aforementioned range for successive sheets from each of the feeders. In other words, the sheets are expelled from the predetermined path until all of the feeders begin to supply sheets whose thickness is being compared with the respective reference value and for which the difference between the monitored thickness and the reference value is not outside of the respective range.

The method can further comprise the step of arresting the machine when the deviation or departure of monitored thickness of a given number of successive sheets from the reference value is outside of the respective range. The presently preferred given number is three because it is quite unlikely that a feeder would supply more than two unsatisfactory sheets one after the other.

Another feature of the present invention resides in the provision of a machine which gathers sheets into stacks or analogous formations or accumulations. The machine comprises a collating conveyor which defines a predetermined path for accumulations of sheets, a plurality of feeders each of which is arranged to deliver a discrete series of sheets into the path, means for monitoring the thicknesses of sheets which are supplied by the feeders and for generating first signals which denote the monitored thicknesses, and means (e.g., a computer for each feeder) for processing the first signals including means for evaluating the signals which denote the monitored thicknesses of n successive sheets and for calculating the range of acceptable deviations of first signals from a reference signal on the basis of the last signal of n successive substantially identical first signals.

Each processing means can include means for altering the range of acceptable deviations on the basis of the last one of a preselected number (e.g., n) of identical first signals.

Each processing means can include means for preventing the delivery of the foremost sheet by the respective feeder so that the corresponding monitoring means then generates a first signal which is indicative of a sheet having zero thickness and constitutes a calibrating signal, and means for comparing the first signal denoting the thickness of the foremost delivered sheet with the respective calibrating signal to thereby ascertain the aforementioned range as a function of the difference between the signal denoting the thickness of the foremost sheet and the calibrating signal.

The machine can further comprise means for expelling sheets from the path which is defined by the collating conveyor prior to completion of calculation of the range of acceptable deviations for each of the feeders.

The machine can also comprise means (e.g., a motor) for arresting the collating conveyor in response to detection of a given number (such as three) of successive first signals whose deviation from the reference signal is outside of the respective range.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
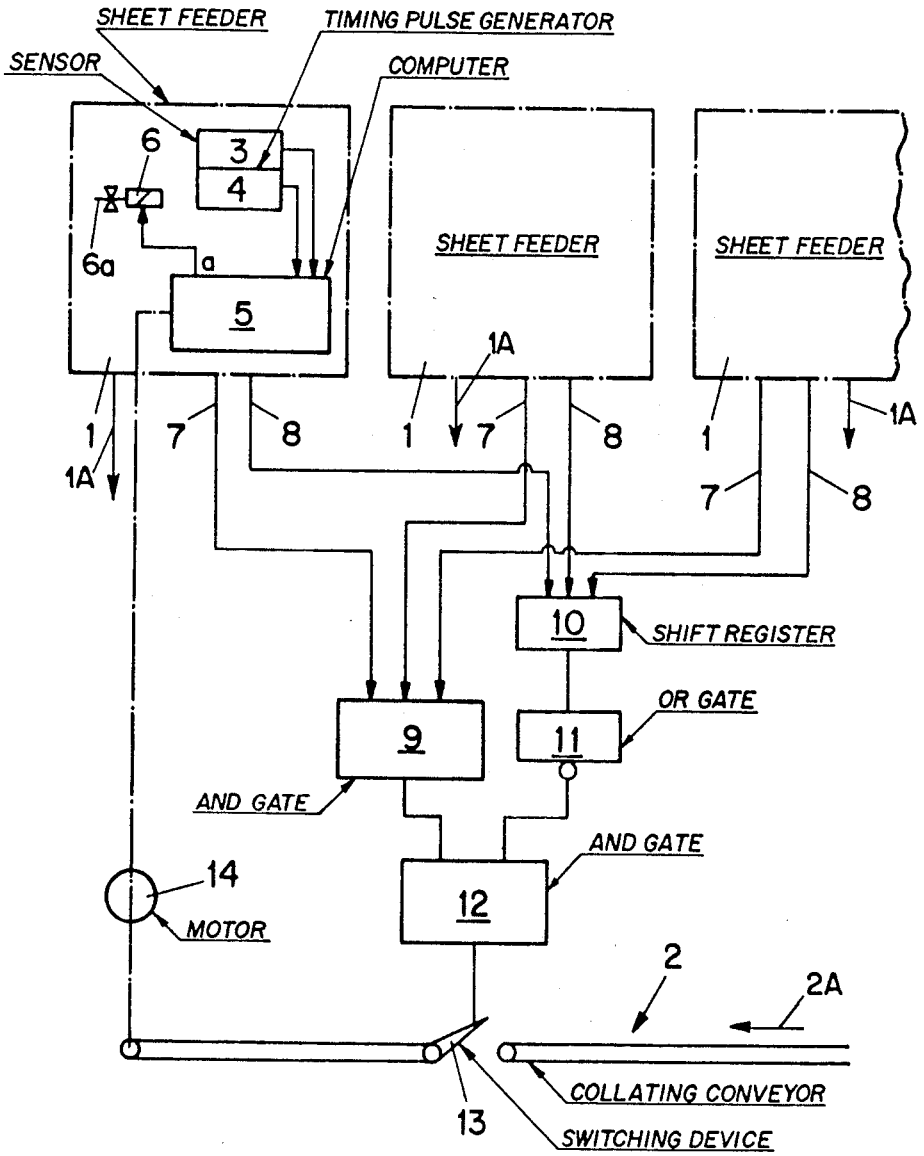
FIG. 1 is a schematic view of a portion of a gathering machine which embodies the invention.

The gathering machine of FIG. 1 is or can be similar to or identical with that which is disclosed in the commonly owned U.S. Pat. No. 3,414,257 to Hans Müler. The reference characters 1 denote three neighboring feeding units or feeders each of which serves to supply a series of successive paper sheets along a separate path 1A into a path 2A defined by a collating conveyor 2 containing a switching device 13 movable between the illustrated open position in which the sheets supplied by the feeders 1 are diverted or expelled from the path 2A and a closed position in which the sheets which are delivered along paths 1A are gathered into stacks or analogous formations in a manner well known from the art and disclosed, for example, in the aforementioned patent to Müler.

Each feeder 1 contains or cooperates with a thickness monitoring device including a sensor 3, a timing pulse generator 4 and a signal evaluating and processing means in the form of a computer 5 wherein the signals denoting thicknesses monitored by the sensor 3 are compared with a reference value and which generates signals denoting the differences between monitored thicknesses of successive sheets which advance along the respective path 1A and the reference value. An output a of the computer 5 transmits signals to a valve 6 which is installed in a suction line 6*a* and controls the delivery of sheets from a magazine into the respective path 1A. The valve 6 is open when the respective feeder 1 delivers sheets into the corresponding path 1A, and the valve 6 is closed in response to a signal from the computer 5 when the supplying of sheets from the magazine of a particular feeder 1 into the path 2A is to be interrupted. The valve 6 can control the evacuation of air from one or more suction cups which are used in the respective feeder 1 to draw sheets from the magazine at a frequency determined by the timing pulse generator 4.

Figure 2:
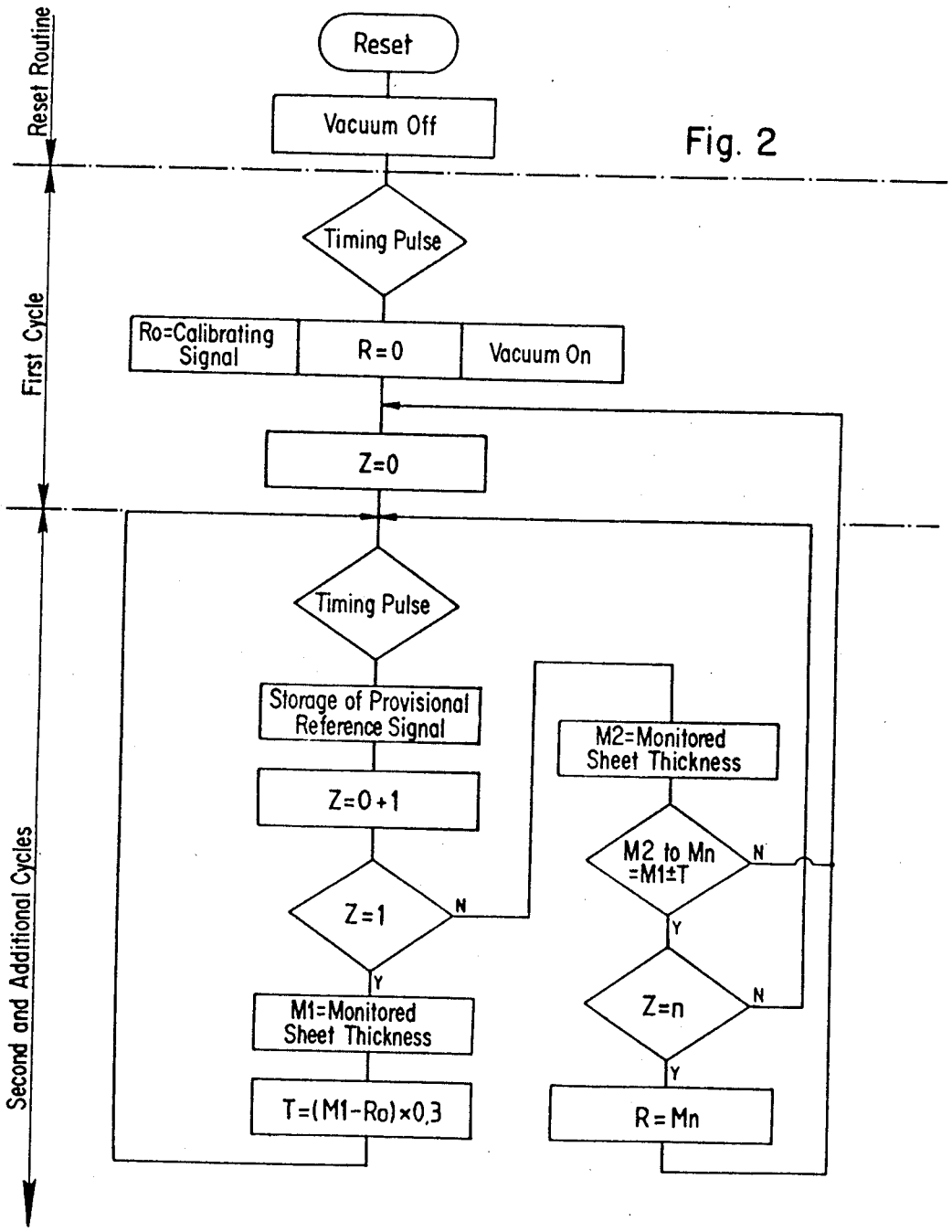
FIG. 2 is a flow diagram showing the manner of establishing reference values and ranges of acceptable thicknesses upon starting of the gathering machine.

When the machine of FIG. 1 is adjusted to change the setup (e.g., to deliver different types of sheets or to activate a larger or smaller number of feeders 1), it is necessary to carry out the prescribed reset routine involving the admission of different sheets into the magazines of the feeders 1, the adjustment of suction cups for removal of discrete sheets from the respective magazines, and/or other operations. The motor 14 of the machine is then set in motion to start the mobile components of the feeders 1 and the collating conveyor 2. At such time, the signal at the output a of each computer 5 causes the respective valve 6 to close (i.e., to interrupt the evacuation of air from the respective suction cup or cups) so that the drums of the feeder 1 (such drums are shown in patent No. 3,414,257) do not receive discrete sheets during the first working cycle of the gathering machine. The timing pulse generators 4 transmit timing pulses at the start of each cycle. When the generators 4 transmit first timing pulses, the respective sensors 3 monitor selected portions of the respective paths 1A to ascertain the thicknesses of the sheets therein. It will be recalled that no sheets are being supplied during the first cycle so that each sensor 3 then transmits a signal Ro (FIG. 2) which can be said to be indicative of a calibrating thickness M, namely of the thickness of a sheet having zero thickness. Such signals are stored in the respective computers 5.

At the same time, namely upon generation of the first timing pulses, the computers 5 erase the theretofore stored reference signals R and reset their counters Z (FIG. 2) to zero. The reference signals R which are erased at such time are those which were used during the last stage of the preceding operation of the gathering machine, i.e., prior to a change of the setup. The outputs a of the computers 5 then transmit signals to open the respective valves 6 so that the suction cups of the feeders 1 are activated and begin to draw sheets from the respective magazines for admission into the corresponding paths 1A. During the next-following (second) cycle, each computer 5 stores a provisional reference signal M1 which is transmitted by the respective sensor 3 in response to the second pulse from the associated timing pulse generator 4 and denotes the thickness of the foremost sheet in the respective path 1A, and the counter Z of each computer 5 increases the recorded count by one. In addition, and if the thickness of the foremost sheet in the path 1A equals M1, the computer 5 of the respective feeder 1 ascertains the extent of deviation T of the measured thickness from an acceptable thickness. For example, the computers 5 can be set up to ascertain whether or not the monitored thickness M1 deviates from the acceptable thickness by more than 30%, i.e., whether or not the thickness M1 exceeds or is below the acceptable average thickness by more than 30%. The thickness M1 equals the actual thickness of the foremost sheet minus the calibrating value Ro.

When the gathering machine completes the next cycle, each computer 5 receives from the associated sensor 3 a (third) signal denoting the actual thickness M2 of the second sheet in the respective path 1A, the count in the respective counter Z is increased by one and the computer 5 stores the signal denoting the value of M2 and ascertains whether or not the value of M2 is outside of the range of M1±T. If the difference between M1 and M2 is acceptable, the operation proceeds until the respective feeder 1 delivers a total of n successive sheets, i.e., until the count in the respective counter Z equals n. If the value Mn during the cycle n+1 (when the count of each counter Z equals n) is also within the acceptable tolerance range ± T, the respective computer 5 stores the signal denoting the value Mn as the next reference signal. The signal denoting the thickness M2, M3, etc. is stored only if the difference between M2 and M1 does not exceed M1±T. If the difference between M2 and M1 or M3 and M2, etc. is unsatisfactory, the respective counter Z is reset and the procedure is automatically repeated so that the respective path 1A ultimately receives a total of n acceptable sheets. In other words, each path 1A must receive and deliver a total of n acceptable sheets before the respective computer 5 calculates and stores a reference signal which is the sum of n acceptable signals divided by n. Thus, each computer 5 will store a reference signal R (to replace the calibrating signal Ro) after the associated sensor 3 has transmitted a series of n signals each of which has an intensity or another characteristic within the acceptable range of M±T.

Each computer 5 has two additional outputs 7 and 8 which respectively serve to transmit signals to the corresponding inputs of an AND gate 9 and a shift register 10. The output of the shift register 10 is connected with the input of an OR gate 11 having an inverting output connected to the corresponding input of an AND gate 12. The output of the AND gate 12 transmits signals which actuate the means (e.g., a servomotor) for moving the switching device 13 between its open and closed positions. The output of the AND gate 9 is connected with the other input of the AND gate 12.

When all three inputs of the AND gate 9 receive signals from the outputs 7 of the computers 5 in the illustrated feeders 1 (each such signal denotes that the respective computer 5 has received n acceptable signals and has calculated and stored a reference signal R≠0), the output of the gate 9 transmits a signal to the corresponding input of the AND gate 12. Furthermore, when all three inputs of the shift register 10 receive appropriate signals from the outputs 8 of the respective computers 5 (such signals denote the total number of sheets which were delivered into the respective paths 1A before the associated computers 5 were in a position to generate a reference signal R), the shift register 10 transmits (with appropriate delay) a signal to the input of the OR gate 11 whose output transmits a signal to the corresponding input of the AND gate 12. If the signal at the output of the AND gate 9 matches the signal at the output of the OR gate 11 (such situation arises when the computers 5 stores a reference signal R≠0 and none of the feeders 1 have delivered unsatisfactory sheets into the range of the switching device 13), the AND gate 12 transmits a signal which initiates the closing of the switching device 13. Thus, the switching device 13 is closed when each computer 5 stores a reference signal R≠0 and when each of the feeders 1 has delivered the same number of sheets in order to enable the respective computer 5 to generate a reference signal R. The conveyor 2 then begins to collate the delivered sheets into books, brochures, pamphlets or other suitable groups and delivers them to the next station, e.g., into the range of a stapling device, not shown. However, if one of the computers 5 has transmitted to the shift register 10 a signal denoting the absence of a sheet during a machine cycle, the two inputs of the AND gate 12 receive different signals and the output of this gate does not initiate a closing of the switching device 13. The switching device 13 then remains open and the corresponding group of sheets is expelled from the path 2A at 13.

FIG. 1 shows that the switching device 13 can be closed only when the outputs 7 of all computers 5 transmit to the AND gate 10 signals denoting the respective reference values R. Up to such time, the switching device 13 remains open so that the groups of sheets which are accumulated following starting of the motor 14 subsequent to completion of a reset operation are discarded regardless of whether or not they contain acceptable accumulations of sheets. This ensures that the machine cannot process unsatisfactory groups of sheets following its restarting (i.e., after completion of a reset operation), namely that the groups are processed into books or the like only after each of the computers 5 has already calculated and stored a proper reference signal R. The number of discards due to such mode of operation is relatively small because, based on extensive tests, the number of successive defective sheets which are supplied by a feeder 1 does not exceed or hardly ever exceeds two.

In accordance with a presently preferred embodiment of the improved method and apparatus, each computer 5 counts the number of successive identical deviations from the acceptable range. If the number of successive identical deviations reaches three, the respective computer 5 transmits a control signal which arrests the motor 14. This is normally indicative that the needles, suction cups or compressed air nozzles of the respective feeder 1 are improperly adjusted and require a further adjustment prior to proceeding with the collating operation. The same procedure takes place during any particular advanced stage of operation of the machine, i.e., if the needles, nozzles or suction cups require adjustment after a relatively short or long period of satisfactory operation of the machine.

An advantage of the improved method and machine is that it is practically impossible to select as reference value the thickness of a defective sheet if n equals or exceeds three because it is highly unlikely (if not impossible) that three defective sheets would follow each other in any one of the paths 1A from the magazines of the feeders 1 to the path 2A which is defined by the collating conveyor 2.

An advantage of the feature that the range of acceptable deviations T is altered when the computer ascertains that the monitored thickness of the last one of a predetermined number of successively delivered sheets coming from the magazine of a particular feeder 1 deviates from the last monitored thickness of the previous n sheets coming from the same magazine is that the gathering machine automatically alters the range of acceptable tolerances as the operation progresses, i.e., that the range of acceptable tolerances is adapted to the characteristics of sheets which are being supplied by the respective feeders.

Calculation of the calibrating value Ro exhibits the advantage that the sensors 3 are properly calibrated at the start of the operation following a change of the setup. This reduces the likelihood of prolonged inaccurate determination of thicknesses of sheets which are being delivered by a particular feeder 1. The calibration of each sensor 3 is taken into consideration during calculation of the respective range of acceptable tolerances.

An advantage of the feature that the switching device 13 ensures the expulsion from the path 2A of all sheets which are gathered into stacks prior to determination of the range T for each of the feeders 1 is that the operator is merely called upon to actuate the start button of the gathering machine to thereby ensure that the next processing station (such as the stapler) does not receive a single unsatisfactory stack or an analogous accumulation of superimposed sheets.

The feature that the machine is arrested when the deviation of monitored thickness of three or more successive sheets from the respective reference value is outside of the preselected range is that the operator in charge is informed that a particular feeder 1 has not been properly adjusted during a change of setup and requires additional adjustment.

The sensors 3, timing pulse generators 4, computers and valves 6 are available on the market, for example, at Muller Martini Corp., Hauppauge, N.Y. Suitable sensors are described in commonly owned copending United States patent application Ser. No. 100,088 filed Sept. 23, 1987 by Peter Geiser. Many other commerically available computers can be used in the apparatus of the present invention in additional to those which are available at Muller Martini Corp.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of manipulating sheets in a gathering machine wherein at least one feeder supplies successive sheets at predetermined intervals into a predetermined path along which the sheets are transported and wherein the sheets are accumulated into stacks or analogous formations, comprising the steps of monitoring the thickness of successive first sheets on their way toward said path; counting the number of successive monitoring steps; calculating a range of acceptable thicknesses based on the last one of a preselected number of successive at least approximately identical first sheet thicknesses, said calculating step being performed in such a manner that the middle of said range is a function of said last monitored first sheet thickness; monitoring the thicknesses of successive second sheets on their way toward said path; comparing the monitored second sheet thicknesses with said range and generating signals denoting the relationship of each monitored second sheet thickness to said range; and expelling said second sheets from said path in response to said signals when monitored second sheet thickness is outside of said range.

2. The method of claim 1, further comprising the steps of counting the number of successive monitoring steps following said calculations step, and employing the last one of a predetermined number of successive at least approximately identical monitored thicknesses following said calculating step to update said range.

3. The method of claim 2, wherein the employing step is repeated regularly.

4. The method of claim 1, further comprising the step of arresting the machine when the monitored thickness of a given number of successive second sheets is outside of said range.

5. The method of claim 4, wherein said given number is three.

6. The method of claim 1, wherein a plurality of feeders supply successive sheets into said path and said steps are performed for the sheets from each of said feeders.

7. The method of claim 1, further comprising the steps of establishing another range of acceptable thicknesses such that the middle of said other range is the monitored thickness of a foremost single one of said first sheets, comparing the monitored thicknesses of the remainder of said first sheets with said other range and generating additional signals denoting the relationship of each such thickness to said other range, and expelling said first sheets from said path in response to said additional signals when monitored first sheet thickness is outside of said other range.

8. The method of claim 7, wherein the steps of monitoring the thicknesses of successive first sheets, counting the number of monitoring steps, establishing said other range, comparing monitored first sheet thickness with said other range and generating additional signals are repeated whenever first sheets are expelled from said path before said preselected number of successive at least approximately identical monitored first sheet thicknesses is obtained.

9. A machine for gathering sheets into stacks or analogous accumulations, comprising a collating conveyor defining a predetermined path for accumulations of sheets, a plurality of feeders each of which is arranged to deliver a discrete series of sheets into the path, means for monitoring the thicknesses of sheets which are supplied by the feeders and for generating first signals denoting the monitored thicknesses, and means for processing said signals including means for evaluating the signals denoting the monitored thicknesses and for calculating an acceptable range of signals on the basis of the last signal of n successive at least approximately identical first signals, said processing means being programmed to calculate said range in such a manner that the middle of said range is said last signal.

10. The machine of claim 9, wherein said monitoring means is designed to generate second signals following calculation of said range and denoting monitored sheet thicknesses, said processing means including means for updating said range on the basis of the last one of a preselected number of successive at least approximately identical second signals.

11. The machine of claim 10, wherein said processing means is designed to repeatedly and regularly update said range.

12. The machine of claim 9, further comprising means for arresting said conveyor in response to detection of a given number of successive first signals outside of the respective range.

13. The machine of claim 12, wherein said given number is three.

14. The machine of claim 9, wherein said monitoring means is designed to generate second signals following calculation of said range and denoting monitored sheet thicknesses, said processing means being designed to compare said second signals with said range and to generate third signals denoting the relationship of each second signal to said range; and further comprising means for expelling sheets from said path in response to said third signals when a second signal is outside of said range.

15. The machine of claim 14, wherein said first signals denote the monitored thicknesses of a group of first sheets and said second signals denote the monitored thicknesses of a group of second sheets, said processing means being designed to establish another acceptable range of signals such that the middle of said other range corresponds to a first signal denoting the monitored thickness of a foremost single first sheet, and said processing means further being designed to compare the remaining first signals with said other range and to generate additional signals denoting the relationship of each remains first signal to said other range, said expelling means being arranged to expel first sheets from said path in response to said additional signals when a remaining first signal is outside of said other range.

16. The machine of claim 15, wherein said processing means is designed to reestablish an acceptable range corresponding to said other range, to compare first signals with the reestablished range and to generate additional signals in automatic response to expulsion of first sheets from said path before n successive at least approximately identical first signals are obtained.

17. A method of manipulating sheets in a gathering machine wherein at least one feeder supplies successive sheets at predetermined intervals into a predetermined path along which the sheets are transported and wherein the sheets are accumulated into stacks or analogous formations, comprising the steps of monitoring the thicknesses of successive sheets on their way toward said predetermined path by scanning, at said intervals, a second path wherein the sheets advance toward said predetermined path; counting the number of successive monitoring steps; utilizing the last one of a preselected number of successive at least substantially identical monitored thicknesses to select a range of acceptable thicknesses; comparing the monitored thicknesses of successive sheets with a reference value and generating signals denoting the deviation of each monitored thickness from the reference value; expelling the sheets from said predetermined path in response to said signals when the deviation of the monitored thickness from the reference value is outside of said range; monitoring said second path in the absence of a sheet therein to thus establish a calibrating thickness; comparing the monitored thickness of the foremost sheet of said successive sheets with said calibrating thickness; and selecting a range of acceptable thicknesses as a function of the difference between the monitored thickness of the foremost sheet and the calibrating thickness.

18. A method of manipulating sheets in a gathering machine wherein several feeders supply successive sheets at predetermined intervals into a predetermined path along which the sheets are transported and wherein the sheets are accumulated into stacks or analogous formations, comprising the steps of monitoring the thicknesses of successive sheets on their way toward said path; counting the number of successive monitoring steps; utilizing the last one of a preselected number of successive at least substantially identical monitored thicknesses to select a range of acceptable thicknesses; expelling from said path the sheets which are supplied by the feeders until after completion of selection of such range for successive sheets from each of the feeders; comparing the monitored thicknesses of successive sheets with a reference value and generating signals denoting the deviation of each monitored thickness from the reference value; and expelling the sheets from said path in response to said signals when the deviation of the monitored thickness from the reference value is outside of a range of acceptable thicknesses.

19. A machine for gathering sheets into stacks or analogous accumulations, comprising a collating conveyor defining a predetermined path for accumulations of sheets; a plurality of feeders each of which is arranged to deliver a discrete series of sheets into the path; respective means for monitoring the thicknesses of sheets which are supplied by the feeders and for generating first signals denoting the monitored thicknesses; and respective means for processing said signals and each including means for evaluating the signals denoting the monitored thicknesses and for calculating a range of acceptable deviations of signal from a reference signal on the basis of the last signal of n successive substantially identical first signals, means for preventing the delivery of the foremost sheet by the respective feeder so that the respective monitoring means then generates a first signal which is indicative of a sheet having zero thickness and constitutes a calibrating signal, and means for comparing the first signal denoting the thickness of the foremost delivered sheet with the respective calibrating signal to thereby ascertain a range of acceptable deviations of signals from a reference signal as a function of the difference between the signal denoting the thickness of the foremost delivered sheet and the calibrating signal.

20. A machine for gathering sheets into stacks or analogous accumulations, comprising a collating conveyor defining a predetermined path for accumulations of sheets; a plurality of feeders each of which is arranged to deliver a discrete series of sheets into the path; means for monitoring the thicknesses of sheets which are supplied by the feeders and for generating first signals denoting the monitored thicknesses; means for processing said signals including means for evaluating the signals denoting the monitored thicknesses and for calculating a range of acceptable deviations of signals from a reference signal on the basis of the last signal of n successive substantially identical first signals; and means for expelling sheets from said path prior to completion of calculation of said range for each of said feeders.

* * * * *